US010362825B2

(12) United States Patent
Judge

(10) Patent No.: US 10,362,825 B2
(45) Date of Patent: Jul. 30, 2019

(54) ROTATABLE BRIM CAP WITH STABILIZED TRACK TRANSITION INTERFACE

(71) Applicant: Clayton Judge, Denver, CO (US)

(72) Inventor: Clayton Judge, Denver, CO (US)

( * ) Notice: Subject to any disclaimer, the term of this patent is extended or adjusted under 35 U.S.C. 154(b) by 136 days.

(21) Appl. No.: 15/813,928

(22) Filed: Nov. 15, 2017

(65) Prior Publication Data

US 2019/0142095 A1 May 16, 2019

(51) Int. Cl.
*A42B 1/06* (2006.01)
*A42B 3/04* (2006.01)

(52) U.S. Cl.
CPC ..... *A42B 1/064* (2013.01)

(58) Field of Classification Search
CPC ..... A42B 1/064; A42B 1/22; A42B 1/062; A42B 1/205; A42C 5/00
See application file for complete search history.

(56) References Cited

U.S. PATENT DOCUMENTS 5,437,062 A * 8/1995 Douglas ..... A42B 1/064 2/10
5,471,684 A * 12/1995 Casale ..... A42B 1/064 2/10
5,533,211 A * 7/1996 Mehrens ..... A42B 1/064 2/181
5,613,246 A * 3/1997 Alexander ..... A42B 1/064 2/10
5,715,534 A * 2/1998 Mobley ..... A42B 1/064 2/10
5,870,772 A * 2/1999 Sprouse ..... A42B 1/064 2/10
6,263,508 B1 * 7/2001 Davis ..... A42B 1/064 2/10
6,789,267 B2 * 9/2004 Ahn ..... A42B 1/064 2/175.1
RE38,774 E * 8/2005 Davis ..... A42B 1/064 2/10
7,240,373 B2 * 7/2007 Ahn ..... A42B 1/064 2/175.1
9,980,528 B2 * 5/2018 Reinhart ..... A42B 1/064
10,219,569 B2 * 3/2019 Olivera, II ..... A42B 1/064
2004/0040067 A1 * 3/2004 Pong ..... A42B 1/22 2/195.2
2004/0055073 A1 * 3/2004 Ahn ..... A42B 1/064 2/171
2004/0244094 A1 * 12/2004 Ahn ..... A42B 1/064 2/175.3

* cited by examiner

*Primary Examiner* — Robert H Muromoto, Jr.
(74) *Attorney, Agent, or Firm* — Myron Greenspan; Lackenbach Siegel LLP

(57) ABSTRACT

A cap includes an elongate track that extends along the lower edge of the crown has opposing free ends or edges when formed along a generally circular path. A slide, connected to the brim, can slide along the track. A pin or wire aligns the opposing edges of the track when brought into abutment to form an interface parting line. One or more tapes extend across the interface parting line to prevent relative movements of the opposing edges about the pin or wire thereby fixing and stabilizing the opposing edges at the interface parting line to maintain alignment and eliminate discontinuities at the opposing edges to insure smooth movements of the brim independently of the position of said brim along the track.

20 Claims, 4 Drawing Sheets

DETAIL A
SCALE 3.000

ROTATABLE BRIM CAP WITH STABILIZED TRACK TRANSITION INTERFACE

BACKGROUND OF THE INVENTION

1. Field of the Invention

The present invention generally relates to hats and caps and, more specifically, to a cap with a rotatable brim having a stabilized track transition interface to ensure simple and seamless movements of the brim about circumference of the crown of the cap.

2. Description of the Prior Art

Numerous hats and caps with moveable brims have been proposed. Examples of such hats are disclosed in the following patents: U.S. Pat. Nos. 5,715,534, 5,870,772, 66,263, 508, U.S. Publication No. US 2004/0040067 and U.S. Pat. No. RE38,774.

All of the caps disclosed in the aforementioned patents utilize track or guide assemblies for sliding the brim in relation to the cap crown. The guide assemblies typically include an elongate track with free ends or edges, the track being formed into a generally circular configuration to bring the free edges into juxtaposed positions or into abutment with each other. The slide attached to the brim can easily move about the longitudinal track. However, the free ends or edges, while in abutment, are not always in perfect alignment and this creates discontinuities that interfere with the free sliding movements of the brim when such discontinuities are encountered. This may be frustrating when the brim is stopped during sliding movements and the track needs to be manipulated in order to allow the brim continued movement.

In U.S. Pat. No. 5,471,684 to Casall a convertible sports cap with a sliding brim is disclosed. The patent teaches the use of a double-ended fastener having barbed free ends designed to be inserted within associated openings formed in the juxtaposed free ends of the track. However, the use of such a double ended fastener or pin, while aligning the openings of the track, does not prevent relative movements of the juxtaposed edges relative to each other about the pin. Since the edges can still move about the axis of the pin this introduces discontinuities in the track.

In U.S. Pat. Nos. 6,789,267 and 7,240,373 to Ahn, a hat with a rotatable brim is disclosed in which a supporting bridge is used to connect portions of the two ends of the track to each other. The support bridge is intended to maintain close butting engagement of the ends of the track despite adverse conditions including weather, perspiration and use over a extended period of time. The support bridge is described as avoiding interference from the ability of the wearer to slightly separate the two ends to remove the brim from the crown. However, the bridge does not eliminate discontinuities of the track.

SUMMARY OF THE INVENTION

In view of the foregoing, it is an object of the invention to provide a hat with a brim that is rotatable relative to the crown portion thereof without encountering discontinuities in the track as the brim is moved across the interface parting line formed by the free ends or edges of the track when these are brought into abutment or close proximity of each other.

It is still another object of the invention to provide a rotatable brim hat as in the previous objects that has a track that can be quickly and accurately aligned while eliminating discontinuities that would normally be experienced by a slide member attached to a brim. It is another object of the invention to provide a cap with a rotatable brim that is easily and quickly assembled.

It is still another object to provide a cap of the type under discussion that is simple in construction and economical to manufacture.

In order to achieve the above objects, as well as others that will become evident hereinafter, a cap with a rotatable brim in accordance with the invention comprises a cap with a rotatable brim, the cap having a crown with a substantially circular circumferential lower edge to fit on a wearer's head and has an inner surface along said lower edge. A brim has an arcuate edge attached to said crown and extends substantially outwardly away from said crown. An elongate track extends along said circumferential lower edge attached to said inner surface and has opposing free ends or edges when formed along a generally circular path. An elongate slide has a length substantially equal to said arcuate edge of said brim and is connected to said brim along said arcuate edge. Said track and slide form interlocking means for allowing movements of said elongate slide only along the entire length of said elongate track. First alignment means aligns the opposing edges when brought into abutment to form a substantially continuous track with an interface parting line. Second alignment means extends across at least a portion of said interface parting line to prevent relative movements of said opposing ends or edges about said first alignment means. Said first and second alignment means fix and stabilize said opposing edges at said interface parting line to maintain alignment and eliminate discontinuities of said opposing edges in said elongate track to insure smooth movements of said brim independently of the position of said brim along said elongate track.

BRIEF DESCRIPTION OF THE DRAWINGS

Those skilled in the art will appreciate the improvements and advantages that derive from the present invention upon reading the following detailed description, claims, and drawings, in which:

DESCRIPTION OF PREFERRED EMBODIMENT

Figure 1:
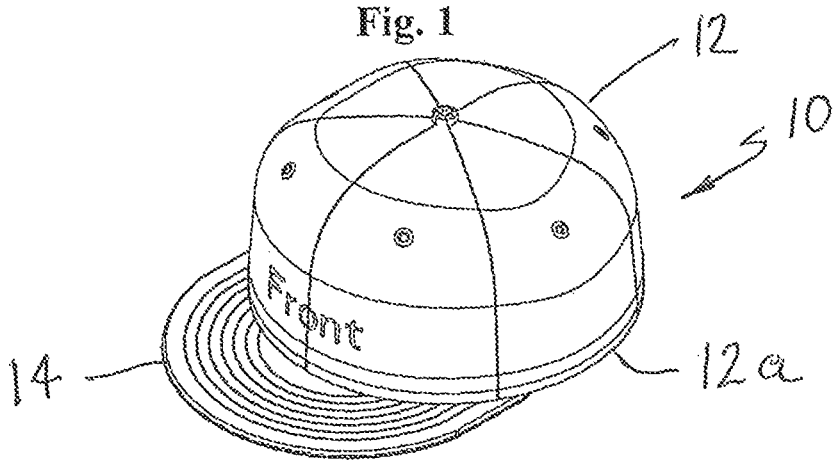
FIG. 1 is a perspective view of a cap with a rotatable brim in accordance with the present invention.
Figure 2:
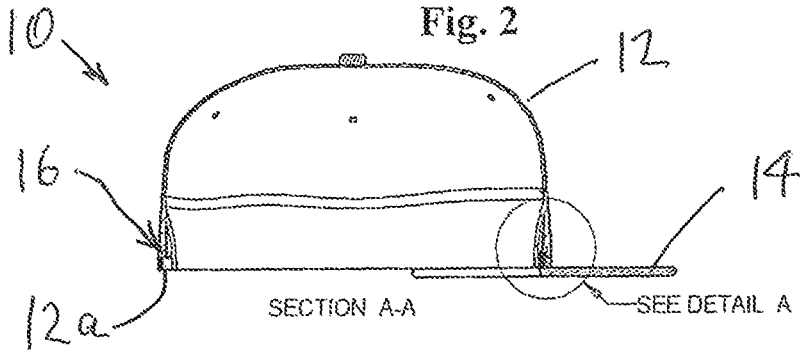
FIG. 2 is a sectional view of the cap shown in FIG. 1 taken along a cutting plane of symmetry through the crown and the brim.

Referring now specifically to the Figures, in which identical or similar parts are designated by the same reference numerals throughout, and first referring to FIGS. 1 and 2, a cap in accordance with the invention is generally designated by the reference numeral 10.

Figure 3:
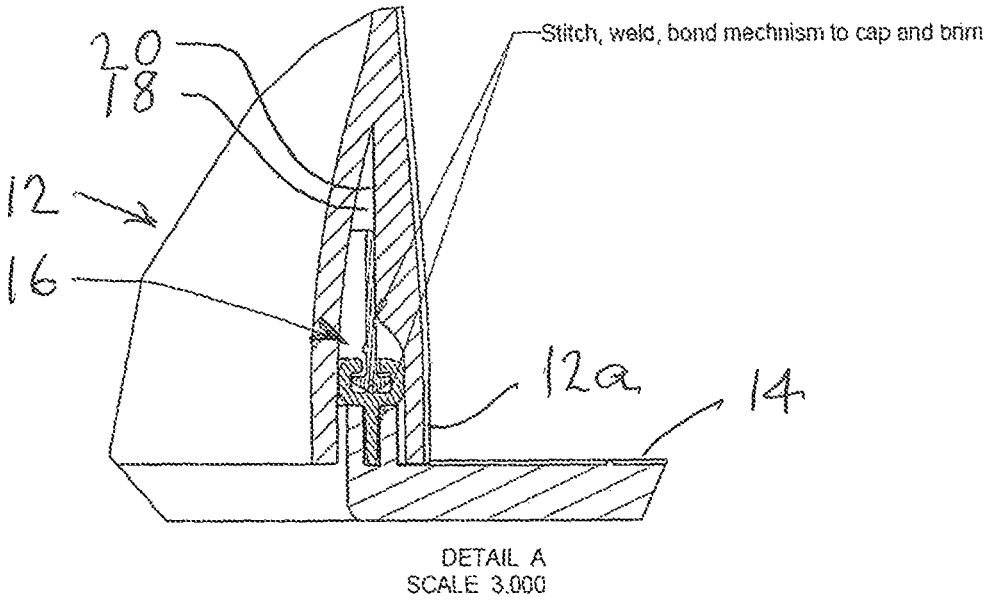
FIG. 3 is an enlarged detail of the details shown in FIG. 2.

The cap 10 includes a crown 12 having a lower circumferential edge 12*a*. The cap preferably includes a head band 12*b* to protect the wearer's head from contact with a guide or track assembly 16. The lower edge 12*a* and the headband 12*b* together form a circumferential or annular space 18 for housing the guide or track assembly 16 as best shown in FIG. 3. A brim or bill 14 has an arcuate edge attached to the crown 12 and extends substantially outwardly away from the crown as shown in FIGS. 1-3. The guide or track assembly 16 is secured within the space 18 in any conventional manner, such as stitching, adhesive, heat sealing or welding or the like to, for example, an inner surface 20 of the crown 12.

Figure 4:
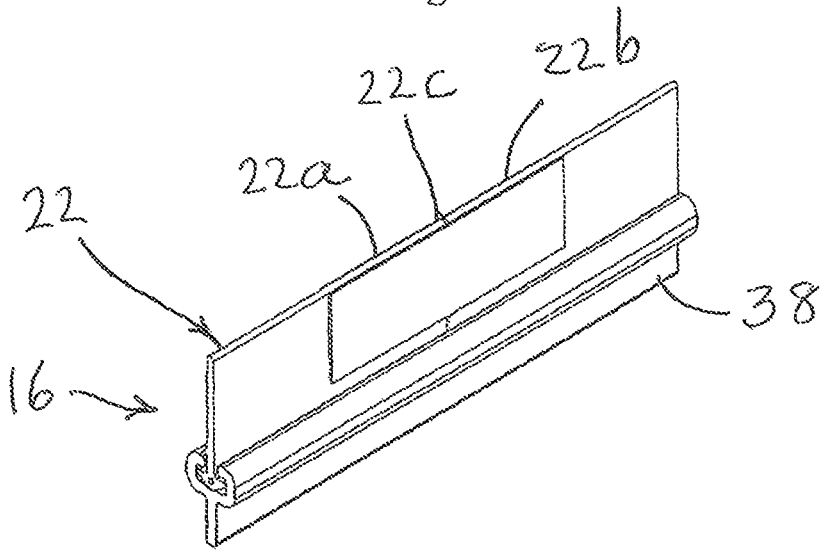
FIG. 4 is a perspective view of a portion of the track shown in FIG. 3 illustrating the interface parting line at the free ends or edges of the elongate track and the manner in which the interface parting line is bridged by a strip of alignment and stabilizing tape.
Figure 5:
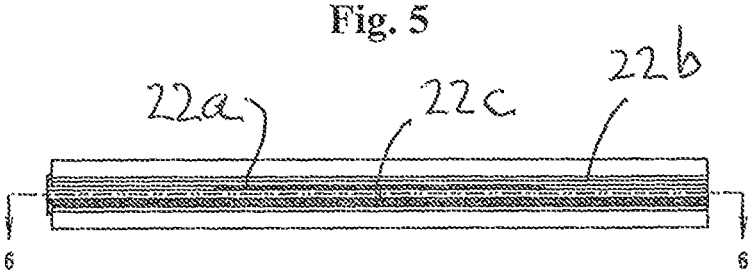
FIG. 5 is a top plane view of the elongate track and slide shown in FIG. 4.
Figure 6:
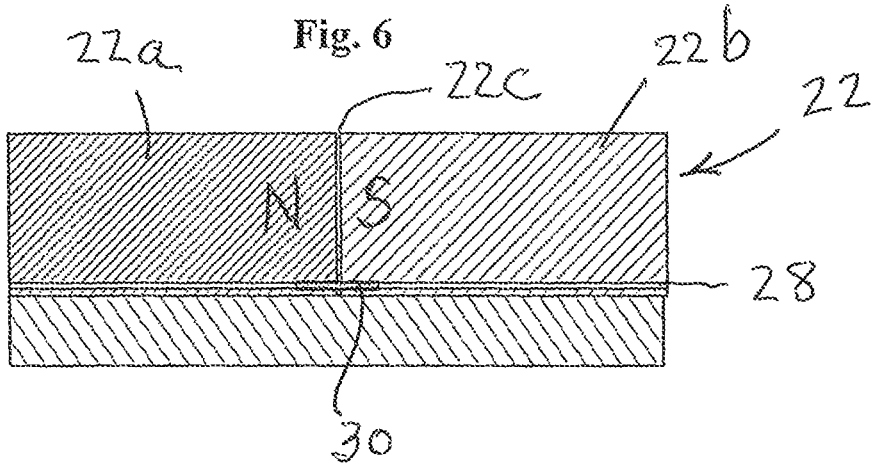
FIG. 6 is a cross section taken through the elongate track and slide shown in FIG. 5, taken along line 6-6.

Referring to FIGS. 4-6, the track assembly 16 includes an elongate track 22 having a length generally corresponding to the circumference of the lower edge 12*a* and has free end portions 22*a*, 22*b* that are to be aligned when the track is formed along a generally circular path. In FIGS. 4-6, only a portion of the track is shown that includes the free end portions 22*a*, 22*b* of the track, it being understood that the track continues to form the generally circular path as suggested in FIG. 2.

Figure 9:
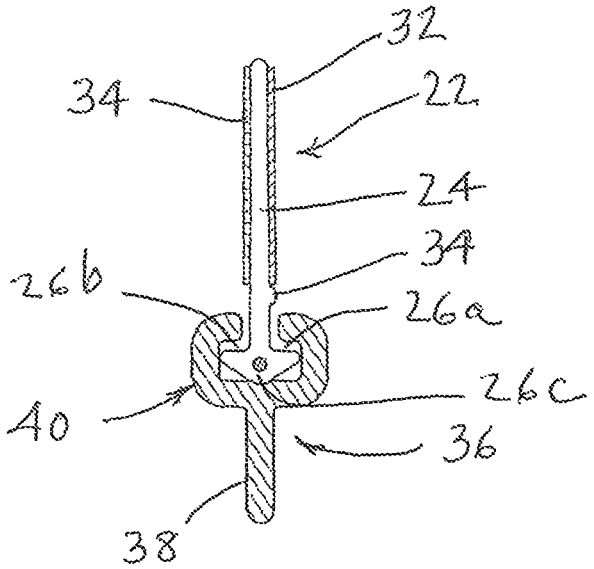
FIG. 9 is an enlarged cross sectional view of the elongate track and slide as shown in FIG. 8, taken along line 9-9.

Referring particularly to FIGS. 4 and 9, the track 22 includes a generally flat elongate strip portion 24 having opposing upper and lower edges (as viewed in the figures). The flat strip portions form generally flat surfaces 24*a*, 24*b* and free ends or edges 24*a*', 24*b*'. Provided along the lower edge of the flat strip portion 24 is an enlarged transverse portion 26 that forms generally normal surfaces 26*a*, 26*b* to the planes defined by the end portions 22*a*, 22*b*. An apex 26*c* forms an elongate longitudinal edge along the length of the flat strip portion 24. The elongate track 22 thus forms a generally uniform T-shaped cross-section along the entire length of the elongate track. The transverse portion 26, therefore, forms a generally triangular cross-section with the apex directed from or pointed in a direction away from the flat strip portion 24.

The track or guide system may be made of linear low-density polyethylene (LLDPE) extrusion process.

The transverse portion 26 is provided with elongate alignment holes 28 at the opposing free ends or edges 24*a*', 24*b*'. The alignment holes 28 may extend the entire length of the track 22 or only at the free ends or edges 24*a*', 24*b*' sufficiently long to receive opposing ends of an elongate alignment member 30, such as a pin or wire, that can be inserted into the alignment holes and retained therein by press fit and friction. The member 30 facilitates easy and quick alignment of the free ends or edges and maintains them in juxtaposed abutment to form an interface parting line 22*c*. The elongate member 30 is preferably flexible to enable the track 22 to assume a generally circular arc even across the interface or transition region 22*c*. The member 30 may be made of metal or an elastomeric material as long as it is relatively flexible but sufficiently rigid to avoid lateral shifting of the free ends or edges 24*a*', 24*b*' relative to each other once the alignment pin 30 has been inserted.

The transition pin 30 may be in the form of a thin metal wire (e.g. 0.013 inch diameter) that can be press fit into the alignment holes 28. This provides very good alignment and keeps the splice transition true even when bending. The wire is thin enough that it can bend easily and does not create discomfort to the user by distorting the shape of the track form the generally circular configuration needed to conform to the shape of the head of the wearer.

Figure 7:
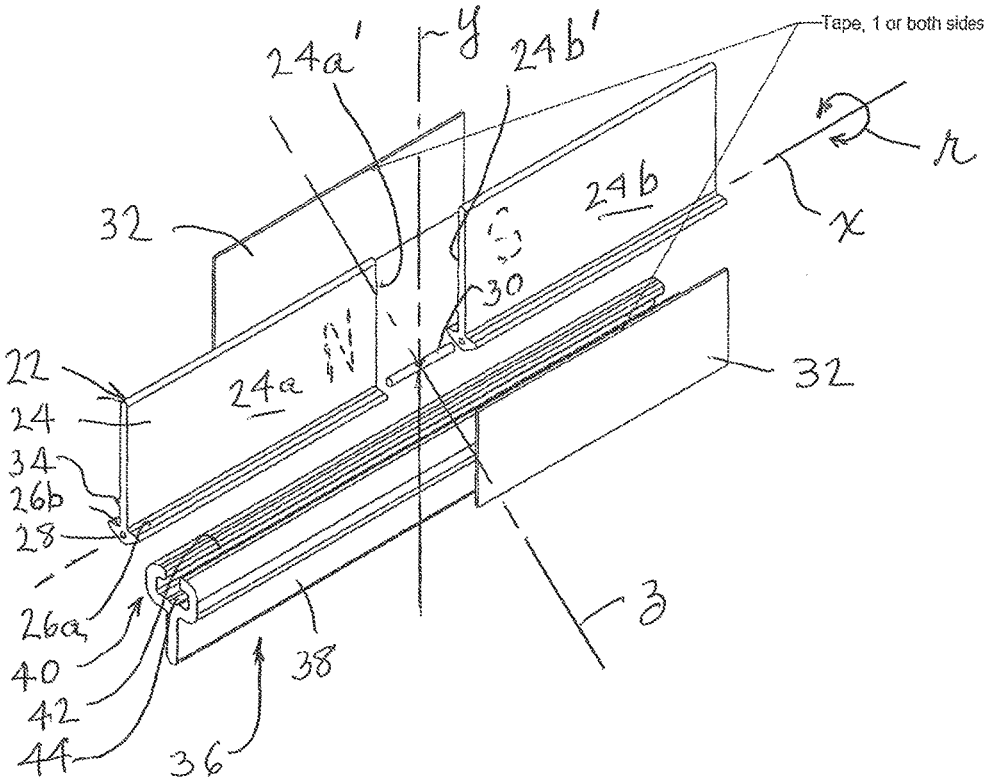
FIG. 7 is an exploded view of the elongate track and slide shown in FIGS. 4-6, illustrating the first and second alignment members in the form of an alignment pin or wire receivable within elongate holes formed in the free ends or edges of the elongate track and the strips of alignment tape that adhere to each of the surfaces of the flat strip portion of the elongate track.

In addition to the alignment pin or wire 30 the strip 22 may, optionally, be magnetized as suggested in FIGS. 6 and 7 to provide magnetic North and South poles at the free ends or edges 22*a*, 22*b* (shown in dash outline in FIG. 7) to assist in aligning the edges and drawing them into contact.

Referring to FIG. 7, the pin 30 serves as a first alignment member to facilitate initial alignment and fixing of the free ends or edges 24*a*', 24*b*' along longitudinal direction "x" while preventing relative movements along the "y" and "z" directions. However, because the first alignment member 30 would not, alone, normally prevent rotational movements r about the first alignment member or pin 30, a second alignment means is applied to the free ends or edges 24*a*', 24*b*' against all movements in relation to the x, y and z axes and rotations "r" about the x axis (FIG. 7) to stabilize the opposing free ends or edges at the interface parting line 22*c* to maintain full alignment and eliminate any discontinuities at the free ends or edges in the elongate track.

Figure 8:
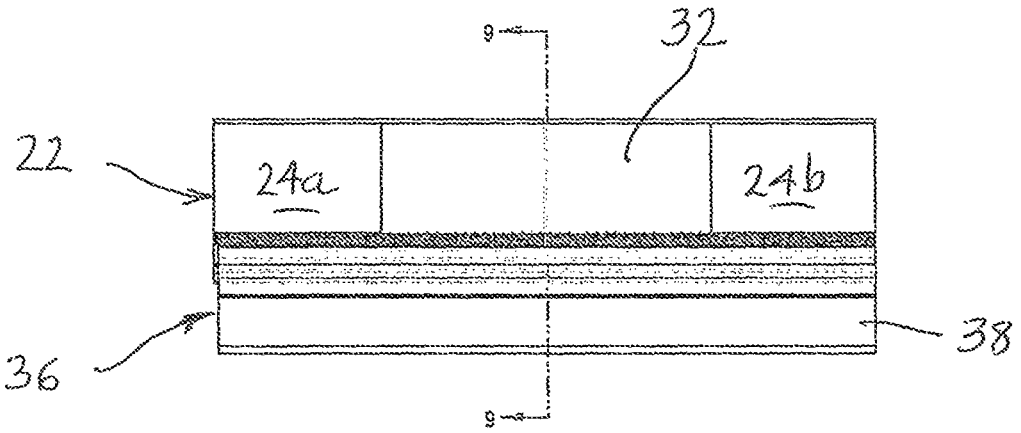
FIG. 8 is a side elevational view of the elongate track and slide shown in FIGS. 4-6.

In the presently preferred embodiment the second alignment means is in the form of strips of tape 32 that are attached to the surfaces 24*a*, 24*b* formed on the flat strip portion 24 attached across the interface parting line 22*c* as shown in FIGS. 4 and 6, although a single flat strip may be attached to one side or one surface of the flat strip portion. As suggested in FIG. 7, two flat strips can be used attached to the opposing surfaces of the flat strip portion as shown in FIGS. 8 and 9. It will be clear, therefore, that by application of the tape strips 32 the free ends or edges 24*a*' and 24*b*' forming the interface or transition parting line 22*c* not only attain perfect alignment along the x, y, and z directions but, additionally, also prevent rotation r of the free ends or edges relative to each other about the axis x defined by the alignment pin member 30. A longitudinal bead 34' is advantageously provided on one or both sides of the track 22 as a guide in applying the strips of tape 32. The adhesive tape can be any suitable adhesive tape, such as PET backed tape with acrylic adhesive.

The track provides a circumferential or circular guide inside the lower edge of the cap. A slide 36 is configured to slide along the track 22. The slide 36 has a length substantially equal to the arcuate edge of the brim and is connected to the brim along the arcuate edge. As is typical with such cap constructions, the track and slide form an interlocking arrangement for allowing movements of the slide only along the length of the track but the slide is otherwise captured and cannot be separated from the track once the track is closed upon itself. The slide includes an elongate flat portion 38. A C-shaped cross-section receptacle 40 is attached to the flat portion 38. However, the orientation of the flat portion 38 in relation to the receptacle 40 is not critical and may differ in size or shape depending on the cap construction as long as it is suitable for attachment to the brim 14. In the embodiment shown, the flat portions 38 depends downwardly, as viewed in the figures, from the C-shaped receptacle 40 for attachment to an upwardly-facing groove within the brim. The slide, therefore, comprises and elongate channel 40' having a generally uniform "C"-shaped cross-section and having a longitudinal slot 42 for passage of the flat strip portion 24 with clearance and for slidably receiving the transverse portion 26 of the elongate track. The elongate channel 40' is provided with a longitudinal internal groove 44 opposite the longitudinal slot 42 for receiving at least an edge of the transverse portion 26 formed along the apex 26*c*. The slide 36 is preferably extruded to provide the groove 44 and provided with rounded corners as shown to maintain more consistent wall thickness and decrease warp during extrusion. The groove 44 is dimensioned to provide substantially uniform thickness cross-section of the elongate channel. It will be clear that the slide 36 has no discontinuities along its length. Once the free ends or edges 24*a*', 24*b*' are mated and aligned by the elongate member or pin 30 and the section or sections of tape 32 track 22 applied this stabilizes the track so it does not exhibit any discontinuities at the interface or transition line 22*c*. Now, the slide 36 can slide along the entire periphery of the cap along the circumferential track 22 without interference.

The combination of a wire and the tape on both sides creates a reliable seam and smooth transition that can be accurately aligned if done before stitching of the track to the crown. The wire creates accurate alignment while creating a natural curve and the tape adds reinforcement via a flat portion 24.

In assembling the sliding track assembly for a cap with a rotatable brim in accordance with the invention, therefore, the slide 36 is placed on the track 22 in interlocking relationship as shown in FIG. 4. The track free ends or edges 24*a*', 24*b*' are provided with associated alignment holes 28. The track 22 is configured to bring the free ends or edges into juxtaposed abutting positions as shown in FIGS. 4-6 along a generally circular path. The opposing free ends or edges are aligned or brought into abutment and the alignment pin or wire 30 is inserted into the alignment holes 28 to form a substantially continuous track with an interface parting line 22*c*. One or two tapes 32 are applied across at least a portion of the interface parting line 22*c* to prevent relative movements of the opposing free ends or edges about the pin or wire. In this manner, the free ends or edges are fixed and stabilizes the interface parting line to maintain alignment and eliminate discontinuities at the free ends or edges in the elongate track to ensure smooth seamless movements of the brim attached to the slide independently of the position of the brim along the elongate track.

It will be clear from the aforementioned that the present invention involves two different splicing or alignment methods used to give a smoother transition across the seam or interface transition lines formed in the track.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A cap with a rotatable brim comprising a crown having a substantially circular circumferential lower edge to fit on a wearer's head and having an inner surface along said lower edge; a brim having an arcuate edge attached to said crown and extending substantially outwardly away from said crown; an elongate track extending along said circumferential lower edge attached to said inner surface and having opposing free ends or edges when formed along a generally circular path; an elongate slide having a length substantially equal to said arcuate edge and connected to said brim along said arcuate edge, said track and slide forming interlocking means for allowing movements of said elongate slide only along the entire length of said elongate track; first alignment means for aligning said opposing edges when brought into abutment to form a substantially continuous track with an interface parting line; and second alignment means extending across at least a portion of said interface parting line to prevent relative movements of said opposing edges about said first alignment means, whereby said first and second alignment means fix and stabilize said opposing free ends or edges at said interface parting line to maintain alignment and eliminate discontinuities of said opposing edges in said elongate track to insure smooth movements of said brim independently of the position of said brim along said elongate track.

2. A cap as defined in claim 1, wherein said elongate track comprises an elongate generally flat strip portion and an enlarged generally transverse portion along an elongate edge of said flat strip portion to form a generally uniform T-shaped cross-section along the entire length of said elongate track.

3. A cap as defined in claim 2, wherein said flat strip portion defines a connecting surface; and attachment means for attaching said connecting surface to said crown inner surface.

4. A cap as defined in claim 3, wherein said attachment means comprises stitching.

5. A cap as defined in claim 3, wherein said attachment means comprises an adhesive bond.

6. A cap as defined in claim 3, wherein said attachment means comprises a weld or seal bond.

7. A cap as defined in claim 2, wherein said elongate slide comprises an elongate channel having a uniform cross-section generally in the shape of a "C" having a longitudinal slot for passage of said flat strip portion with clearance and for slidingly receiving said transverse portion of said elongate track.

8. A cap as defined in claim 7, wherein said transverse portion has a generally triangular cross-section with an apex directed from said flat strip portion, said elongate channel being provided with a longitudinal internal groove opposite to said longitudinal slot for receiving at least an edge of said transverse portion formed along said apex, said groove being dimentioned to provide a substantially uniform thickness cross-section of said elongate channel.

9. A cap as defined in claim 1, wherein said first alignment means comprises associated elongate alignment holes in said opposing edges; and a pin inserted into said associated elongate holes, said associated elongate holes being located to provide alignment of said elongate edges when opposing ends of said pin are inserted therein.

10. A cap as defined in claim 9, wherein said second alignment means comprises flat strip attached across said interface parting line.

11. A cap as defined in claim 2, wherein said second alignment means comprises a flat strip attached to at least one surface formed by said flat strip portion across said interface parting line.

12. A cap as defined in claim 10, wherein said flat strip comprises a strip of tape.

13. A cap as defined in claim 11, wherein said flat strip comprises a strip of tape.

14. A cap as defined in claim 1, wherein said first alignment means comprises a wire received in coextensive alignment holes within said opposing edges.

15. A cap as defined in claim 14, wherein said wire is flexible.

16. A cap as defined in claim 15, wherein said wire is made of metal.

17. A cap as defined in claim 15, wherein said wire is made of an elastomeric material.

18. A cap as defined in claim 2, wherein said flat strip portion defines opposing generally flat surfaces, and said second alignment means comprises a tape applied to at least one of said flat surfaces.

19. A cap as defined in claim 18, wherein tape is applied to both opposing flat surfaces.

20. A method of assembling a sliding track assembly for a cap with a rotatable brim, comprising the steps of connecting an elongate slide, attachable to a brim of the cap, to a track, attachable along the circumferential edge of a crown of the cap, the track having free ends or edges provided with associated alignment holes at the free ends or edges, in interlocking sliding relationship; configuring the track to bring the free ends or edges of the elongate track into juxtaposed abutting positions along a generally circular path; aligning the opposing free ends or edges when brought into abutment and inserting a pin or wire into said alignment holes to form a substantially continuous track with an interface parting line; and applying a tape extending across at least a portion of said interface parting line to prevent relative movements of said opposing free ends or edges about said pin or wire, whereby said free ends or edges are fixed and stabilized at the interface parting line to maintain alignment and eliminate discontinuities at said free ends or edges in the elongate track to insure smooth movements of said brim independently of the position of said brim along said elongate track.

* * * * *